US005234169A

United States Patent [19]

McKenzie

[11] Patent Number: 5,234,169

[45] Date of Patent: Aug. 10, 1993

[54] REMOVABLE SPRINKLER NOZZLE

[75] Inventor: Jeff R. McKenzie, Riverside, Calif.

[73] Assignee: The Toro Company, Minneapolis, Minn.

[21] Appl. No.: 954,792

[22] Filed: Sep. 30, 1992

[51] Int. Cl.[5] ..... B05B 1/26

[52] U.S. Cl. ..... 239/507; 239/201; 239/513; 239/600

[58] Field of Search ..... 239/201, 203–206, 239/240–242, 600, 505, 507, 512, 513

[56] References Cited

U.S. PATENT DOCUMENTS

| | | | |
|---|---|---|---|
| 4,624,412 | 11/1986 | Hunter | 239/205 |
| 4,773,595 | 9/1988 | Livne | 239/203 |
| 4,787,558 | 11/1988 | Sexton et al. | 239/205 |
| 4,892,252 | 1/1990 | Bruninga | 239/205 |
| 4,925,098 | 5/1990 | Di Paola | 239/205 |
| 4,961,534 | 10/1990 | Tyler et al. | 239/205 |
| 5,098,021 | 3/1992 | Kah, Jr. | 239/242 |
| 5,158,232 | 10/1992 | Tyler et al. | 239/288.3 |
| 5,174,501 | 12/1992 | Hadar | 239/201 |

OTHER PUBLICATIONS

Publication Entitled "Service Instructions-Super 606 Interchangeable Nozzle", dated Apr. 1987. The Toro Company, Riverside, Calif.

*Primary Examiner*—Andres Kashnikow
*Assistant Examiner*—Karen B. Merritt
*Attorney, Agent, or Firm*—James W. Miller

[57] ABSTRACT

An improved sprinkler comprises a nozzle body having a nozzle received in a recessed seat provided in a peripheral wall of the nozzle body. The nozzle body has a rotatable upper cover. A cam surface is formed on the cover and extends down into engagement with the nozzle. The cam surface is shaped to push the nozzle at least partially out of its seat during rotation of the cover to allow the user to be able to grip the nozzle and complete its removal by pulling outwardly on the nozzle. The cover also includes a locking rib which can be brought to bear against the nozzle when the nozzle is fully received in its seat to help retain the nozzle in place. Desirably, the cover also includes a radius adjustment screw which is located in front of and spaced away from the front end of the nozzle such that the screw does not in any way engage or bear against the nozzle to prevent damage to the nozzle from the screw.

22 Claims, 2 Drawing Sheets

REMOVABLE SPRINKLER NOZZLE

TECHNICAL FIELD

This invention relates to an irrigation sprinkler and, more particularly, to a sprinkler nozzle that may be easily installed and removed from the sprinkler without using special tools and without damaging the nozzle.

BACKGROUND OF THE INVENTION

Some irrigation sprinklers have nozzles which are press fit into a nozzle seat provided in the side of a nozzle body. The nozzle seat is usually recessed relative to a peripheral sidewall of the nozzle body so that the nozzle when fully received in the seat is largely hidden within the nozzle body. After the nozzle is inserted in the seat, a radius adjustment screw is screwed down in front of the nozzle to deflect the spray exiting from the nozzle to adjust the radius of throw. This screw engages against the top of the front face of the nozzle to keep the nozzle in place in the seat.

One sometimes needs to remove the nozzle from the nozzle body, e.g. to clean the nozzle or to replace the nozzle with a different one having different spray or flow volume characteristics. In the prior art sprinklers just discussed, one first has to unscrew the radius adjustment screw that protrudes down in front of the nozzle to raise the screw up out of the way. Even after this is done, it is difficult to remove the nozzle because the nozzle is recessed inside the nozzle body and cannot be gripped sufficiently to pull it out against the force of the press fit. Thus, one often has to use a tool, such as a screwdriver, which is inserted into the spray apertures of the nozzle to pry the nozzle out of the seat. Once the nozzle is cleaned and replaced in the seat, the radius adjustment screw has to be reset to its previous position, which can be a time consuming trial and error operation.

Keeping in mind that sprinkler nozzles of this type usually comprise molded plastic parts, removing the nozzle by jamming a screwdriver or some other tool into it and prying it out almost always destroys the nozzle, thereby requiring that a new nozzle be inserted in its place. There is no practical way to remove the nozzle just to clean it as the act of removal damages the nozzle. This is a particular disadvantage for sprinklers designed to be installed, serviced and used in the do-it-yourself (DIY) market. Typically, these users do not have a supply of irrigation nozzles on hand, as an irrigation contractor might have, with which to make a replacement. Thus, they will often have to go out and buy some replacement nozzles which is, at the least, an annoyance.

In some prior art sprinklers, once the radius adjustment screw is raised out of the way, the nozzles are removed by applying pressurized water to the sprinkler body to blow the nozzle out of the seat. While this may not damage the nozzle, the nozzles are often lost in the turf surrounding the sprinkler anyway, particularly since the user often has to go to a remote location to turn on the water supply to the sprinkler and is not present when the nozzle is blown out. Moreover, in sprinklers of this type in which the radius adjustment screw is used to hold the nozzle in place, the engagement of the screw against the plastic material making up the nozzle will also often damage the nozzle. Accordingly, prior art sprinklers of the type having recessed nozzles have a number of disadvantages.

SUMMARY OF THE INVENTION

One aspect of this invention is to provide a sprinkler nozzle which may be easily installed and/or removed from a nozzle body without using any tools and without damaging the nozzle.

It is another aspect of this invention to provide a sprinkler nozzle in which the radius adjustment screw is not used to hold the nozzle in place in the nozzle seat, and does not therefore damage the nozzle.

It is another aspect of this invention to provide a sprinkler nozzle which may be removed without disturbing the original setting of the radius adjustment screw.

It is yet another aspect of this invention to provide a simple, selectively operable member on the nozzle body that can be manipulated by the operator to push the sprinkler nozzle at least part of the way out of a recessed seat.

These and other aspects of the invention are embodied in a sprinkler which comprises a nozzle body having a peripheral wall. The nozzle body has a nozzle seat which is recessed relative to the wall of the nozzle body such that the seat extends inwardly from the wall into an interior portion of the nozzle body. A nozzle is press fit into the seat and when fully received in the seat is substantially hidden within the nozzle body so that it cannot be effectively gripped by a user attempting to remove the nozzle. User operable means are carried on the nozzle body for selectively extending the nozzle at least partially out of the seat such that a front end of the nozzle is located exteriorly of the peripheral wall of the nozzle body by a distance which is sufficient to allow the user to grip the nozzle with the user's fingers to thereby allow the user to finish removing the nozzle by pulling the nozzle out of the seat.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
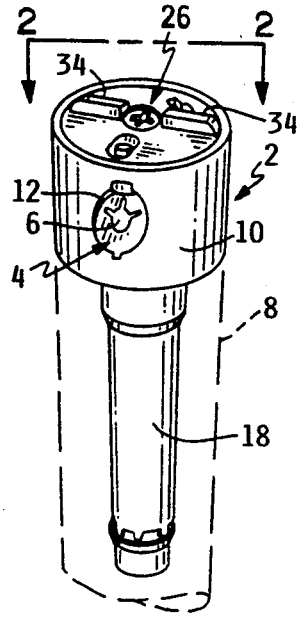
FIG. 1 is a perspective view of a portion of a sprinkler according to the present invention, particularly illustrating the nozzle body and nozzle of the sprinkler.
Figure 2:
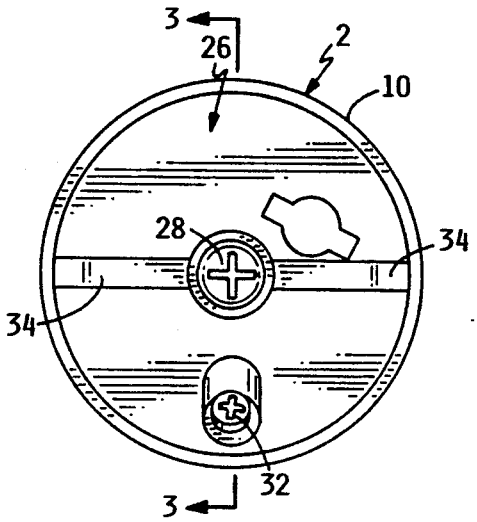
FIG. 2 is a top plan view of the sprinkler nozzle body taken from the direction of lines 2—2 in FIG. 1, particularly illustrating the top surface of the rotatable cover of the nozzle body.

FIG. 1 illustrates a nozzle body 2 that is part of an irrigation sprinkler. A nozzle 4 having a shaped spray aperture 6 is removably carried in nozzle body 2. The present invention relates to a nozzle 4 which can be easily installed and removed from nozzle body 2 without using any tools and without damaging nozzle 4.

Nozzle body 2 is typically carried on the upper end of a riser housing 8 that forms the main body of the sprinkler. Often, nozzle body 2 is rotatably supported on riser housing 8 and is driven by a drive means (not shown) carried inside riser housing 8 so as to rotate in a circle about the longitudinal axis of riser housing 8. This causes the spray exiting from the nozzle to water a circular pattern. The Super 606 sprinklers manufactured and sold by The Toro Company, the assignee of the present invention, are typical examples of irrigation sprinklers having a rotatable nozzle body of this general type. However, the present invention is not limited for use with sprinklers having rotatable nozzle bodies, but could also be used with fixed spray sprinklers in which the nozzle body is stationary and sprays a fixed pattern through nozzle 4.

Nozzle body 2 comprises a cylindrical sidewall 10 having a nozzle receiving seat 12 in which nozzle 4 is press fit. Seat 12 is recessed in nozzle body 2 so that it extends inwardly into the interior of nozzle body 2. Seat 12 can have any cross-sectional configuration which matches the shape of nozzle 4 so that nozzle 4 can be press fit into seat 12. Since nozzle 4 desirably has a cylindrical shape, seat 12 is also preferably cylindrical in shape to allow nozzle 4 to be pushed into seat 12. Nozzle 4 preferably includes a lower key 14 which mates with a keyway 16 in seat 12 to help align nozzle 4 in seat 12.

An upwardly extending water supply tube 18 forms a vertical water flow passageway 20 in nozzle body 4. Pressurized water is admitted by a valve (not shown) to the lower end of riser housing 8 and is able to flow into tube 18 and up through flow passageway 20. Nozzle seat 12 is adjacent an upper end 19 of flow passageway 20 so that nozzle 4 when fully received in seat 12 abuts against upper end 19 of flow passageway 20. In fact, when nozzle 4 is fully received in seat 12, nozzle 4 desirably has its rear end 22 telescopically received inside upper end 19 of flow passageway 20 to conduct water from passageway 20 into nozzle 4 without leaking. See FIG. 3. However, rear end 22 of nozzle 4 could simply be abutted against flow passageway upper end 19 as long as some type of sealing means or other arrangement is provided to allow water to flow from passageway 20 into nozzle 4 without leaking. Of course, once water enters nozzle 4, it exits through spray aperture 6 to be shaped and sprayed exteriorly of the sprinkler.

Figure 3:
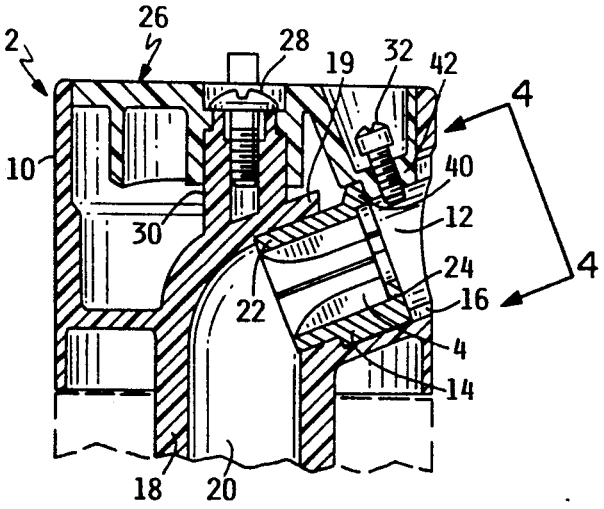
FIG. 3 is a cross-sectional view of the sprinkler nozzle body taken along lines 3—3 in FIG. 2, particularly illustrating the nozzle installed in the nozzle seat and hidden within the nozzle body.

As shown in FIG. 3, when nozzle 4 is fully inserted into seat 12, it is largely hidden inside nozzle body 2. In other words, the front end 24 of nozzle 4 is located interiorly of the cylindrical sidewall 10 that forms the circumference or periphery of nozzle body 2. In this position, nozzle 4 does not extend or protrude outside of nozzle body 2 so that there is no portion of nozzle 4 that can be gripped by the user to remove nozzle 4. Such a recessed orientation of nozzle 4 is often required due to the fact that riser housing 8 often retracts inside of another surrounding housing in a "pop-up" type sprinkler.

Figure 5:
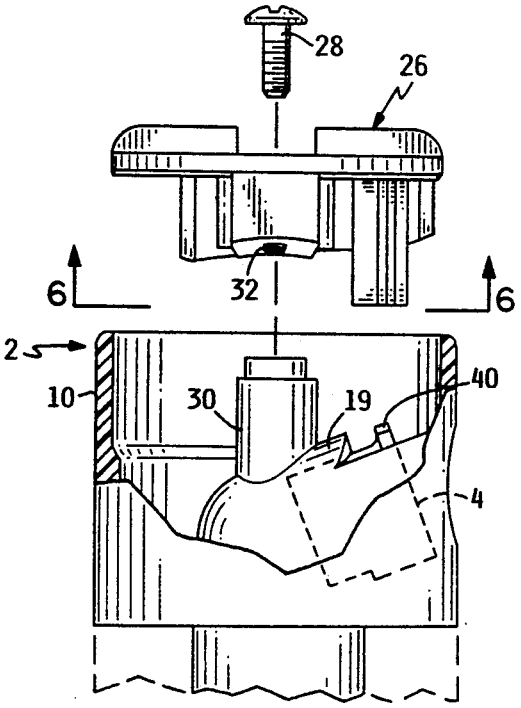
FIG. 5 is a partial, exploded cross-sectional view of the nozzle body shown in FIG. 1, particularly illustrating the cover having been removed from the top of the nozzle body.

An upper cap or cover 26 closes the upper end of nozzle body 2. Cover 26 is held in place by a retaining screw 28 that is threaded down into a threaded boss 30 in the upper end of nozzle body 2. See FIGS. 3 and 5. Cover 26 includes a selectively adjustable screw 32 that extends downwardly in front of the top portion of nozzle 4 when nozzle 4 is received in seat 12. Screw 32 can be selectively adjusted up and down to deflect the water spray exiting from spray aperture 6 to adjust how far the spray is being thrown, i.e. moving screw 32 down further in front of spray aperture 6 will decrease the throw radius and moving screw 32 up will increase the throw radius.

The present invention relates primarily to selectively operable means carried on nozzle body 2 for extending or pushing nozzle 4 at least partially out of seat 12 to allow the user to grip nozzle 4 between his or her fingers to finish pulling nozzle 4 out of nozzle body 2 and for otherwise firmly locking nozzle 4 in its recessed position in seat 12. This means comprises rotatably mounting cover 26 on nozzle body 2 by rotatably journalling cover 26 on top of boss 30. In this regard, the threaded portion of boss 30 is configured so that retaining screw 28 when fully tightened in boss 30 will not be completely tightened against cover 26 so that cover 26 can rotate around the vertical pivot axis defined by boss 30. Cover 26 is preferably provided on its top surface with upwardly extending flanges or tabs 34 that can be gripped by the user to rotate cover 26 back and forth in clockwise and counterclockwise directions.

Figure 7:
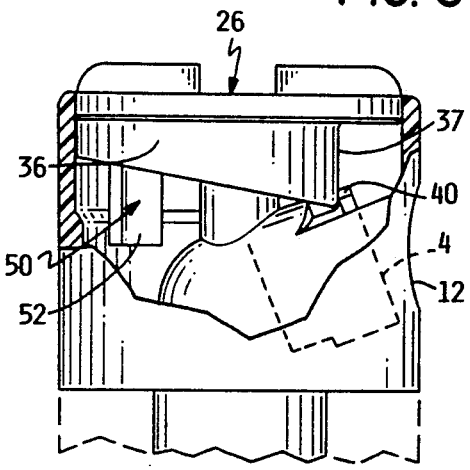
FIGS. 7–9 are partial cross-sectional views of the nozzle body shown in FIG. 1 sequentially illustrating the process of extending or pushing the nozzle out from its seat, with FIG. 7 showing the nozzle in its initial position fully received in the seat, with FIG. 8 showing the nozzle being pushed part of the way out of the seat, and with FIG. 9 showing the nozzle having been pushed to its maximum extent out of the seat at which point it extends exteriorly of the sidewall of the nozzle body by a sufficient distance to allow the user to grip the nozzle and complete its removal.
Figure 8:
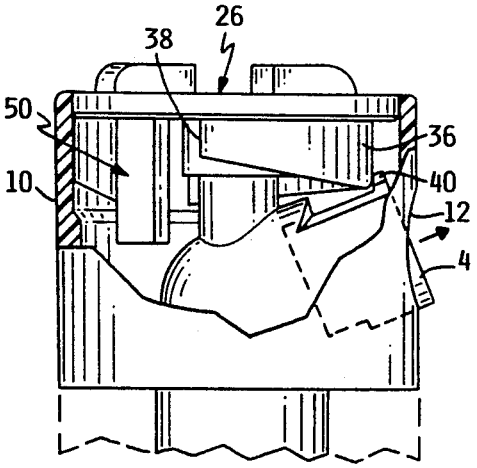
Figure 9:
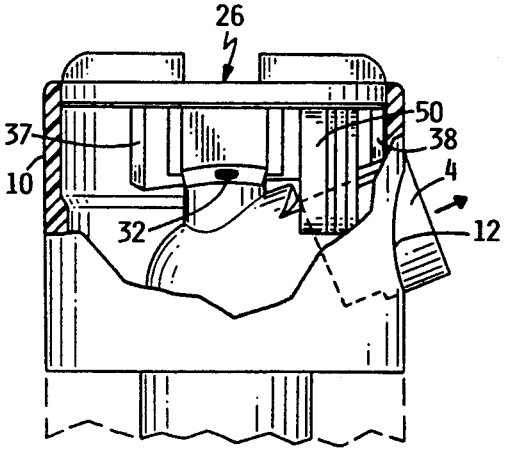

The nozzle extending means comprises a spiral cam surface 36 that is formed on the bottom surface of cover 26. Cam surface 36 extends downwardly from cover 26 sufficiently far so that it can engage behind an upper rib 40 on the top of nozzle 4. Thus, when cover 26 is rotated in a particular direction relative to nozzle body 4, the spiral shape of cam surface 36 between its front end 37 and its rear end 38 will engage against and will progressively push outwardly against rib 40 to push nozzle 4 outwardly from seat 12. This operation is illustrated sequentially in FIGS. 7-9 and will be described more completely hereafter.

In addition to cam surface 36, cover 26 includes a downwardly protruding locking rib 42. The purpose of locking rib 42 is diametrically opposite to that of cam surface 36, namely it is designed to engage against the front of rib 40 to hold nozzle 4 firmly in place in seat 12. This is illustrated in FIG. 3 and will also be described more completely hereafter.

Figure 6:
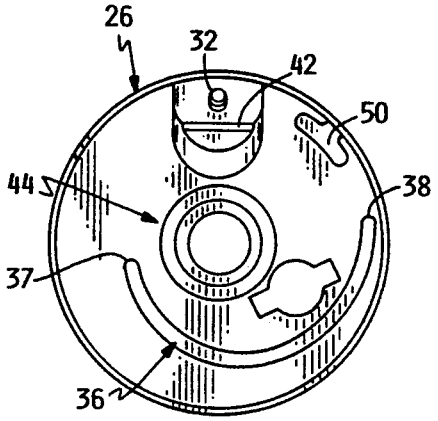
FIG. 6 is a bottom plan view of the underside of the rotatable cover of the nozzle body.

Locking rib 42 is circumferentially spaced from the front end 37 of cam surface 36 by an arc segment designated as 44 in FIG. 6. This arc segment 44 forms an installation window between cam surface 36 and locking rib 42 in which there are no downwardly extending ribs or flanges on cover 26. This window 44 can be aligned with seat 12 to allow nozzle 4 to be pushed inwardly into seat 12.

Turning now to the operation of the invention, assume that a nozzle has not yet been installed in seat 12. To do so, the user rotates cover 26 until window 44 is aligned with seat 12 with window 44 giving unobstructed access to seat 12. The user can then align nozzle 4 with seat 12, by aligning key 14 with keyway 16, and can then push nozzle 4 into seat 12 until it is fully received therein, i.e. until it is in firm engagement with upper end 19 of flow passageway 20. The fit between nozzle 4 is not intended to be an extremely tight press fit. Basically, nozzle 4 is designed to easily slip in and out of seat 12 using only such pressure as can be easily delivered by the user's fingers and hand.

Figure 4:
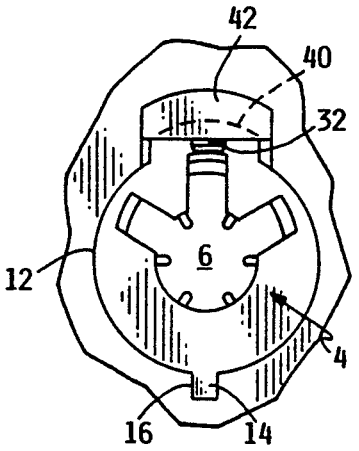
FIG. 4 is a partial front elevational view of a portion of the nozzle body taken from the direction of lines 4—4 in FIG. 3, particularly illustrating the nozzle installed in the nozzle seat in the nozzle body.

After nozzle 4 is received in seat 12, it can be locked in place by rotating cover 26 in a first direction, i.e. counterclockwise in FIG. 6, to cause locking rib 42 to move in front of and to engage against the front of rib 40 on nozzle 4. This orientation is shown in FIGS. 3 and 4. The engagement of locking rib 42 with nozzle rib 40 retains nozzle 4 in place in seat 12 even under the pressure of water being sprayed through nozzle 4. The radius adjustment screw 32 is still used and is adjacent the front face of nozzle 4, but this screw 32 is now spaced away from front face 24 of nozzle 4. See FIG. 3. Accordingly, screw 32 does not engage against or otherwise retain nozzle 4 in place in seat 12 and no longer will damage nozzle 4 as is true of prior art radius adjustment screws that are used to also hold nozzle 4 in place. This is one advantage of the present invention.

Assume now that the user wishes to remove nozzle 4 for some reason, e.g. for cleaning or for replacement. To do so, the user simply rotates cover 26 in the reverse direction, i.e. clockwise in FIG. 6. The first thing that happens is that locking rib 42 is moved back out of the way of rib 40 and window 44 becomes momentarily aligned with rib 40. However, the user will continue the rotation of cover 26 in this direction until the front end 37 of cam surface 36 engages behind rib 40. As rotation continues, cam surface 36 will gradually push outwardly on rib 40 to at least partially extend or push nozzle 4 exteriorly of sidewall 10. See the progression shown in FIGS. 7–9 which shows nozzle 4 being extended out of seat 12. When the rear end 38 of cam surface 36 clears nozzle 4, nozzle 4 has been extended out of seat 12 enough so that the user can now grip and remove the nozzle by pulling outwardly on it with his or her fingers.

As can be seen in the drawings, cam surface 36 has a progressively decreasing height between its front end 37 and its rear end 38. This is due to the inclined orientation of seat 12 relative to the horizontal. Since nozzle 4 rises as it comes up out of seat 12, the height of cam surface 36 has to progressively decrease in a proportional manner in order to allow cam surface 36 to work properly and not jam. The amount of the height decrease in cam surface 36 depends on the angle of inclination of seat 12. If seat 12 is horizontal, for example, then cam surface 36 could have a constant height.

A detent flange 50 is also desirably formed on the underside of cover 26. Flange 50 is longer than cam surface 36 or locking rib 42 and extends down to have its lower end 52 adjacent a thicker portion of sidewall 10. The lower end of detent flange 50 can have edges (not shown) that engage in grooves (not shown) in the inner diameter of sidewall 10. The grooves are spaced apart around sidewall 10 appropriately so that they engage the edges in detent flange 50 to establish three detent positions that can be felt by the user, i.e. a first install position in which window 44 is aligned with seat 12, a second lock position in which locking rib 42 is fully received against rib 40, and a third removal position in which the rear end 38 of cam surface 36 has just cleared rib 40. While use of this type of detent means is preferred to assist the user in manipulating cover 26, the detent means can be deleted and does not form an essential part of the present invention.

The present invention provides a nozzle 4 that can be easily installed or removed in a nozzle body 2 without using any tools and without damaging the nozzle 4 or nozzle seat 12 in any way. To remove the nozzle 4, all the user has to do is to rotate cover 26 in a first direction to allow the cam surface 36 to push the nozzle out of the nozzle seat 12. To install the nozzle 4, the user simply has to align the window 44 with the nozzle seat and push the nozzle in by hand. Then, the user simply rotates the cover to position the locking rib 42 in front of nozzle rib 40 to retain nozzle 4 in place. This is all done without the need for any tools and without having to pry nozzle 4 out of seat 12. Accordingly, nozzle 4 can be more easily removed and replaced than prior art nozzles of this type.

Cam surface 36 and locking rib 42 could be formed on some rotatable member that underlies cover 26 instead of being made as part of cover 26. However, it is desirable to integrate these elements with cover 26 for simplicity.

Radius adjustment screw 32 is also carried on cover so that it rotates with cover 26. In one embodiment of a sprinkler according to the present invention, screw 32 would have sufficient clearance with nozzle body 4, and specifically a slot or the like would be provided in the upper portion of the walls forming nozzle seat 12, so that cover 26 could be turned without having screw 32 hit anything. In this embodiment, the radius adjustment screw 32 would not have to be removed or raised in order to remove nozzle 4, and indeed once set the adjustment of screw 32 would not be disturbed. This is because screw 32 is carried with cover 26 and will be rotated out of the way of nozzle 4 when cover 26 is rotated to engage cam surface 36 with nozzle rib 40. This embodiment would somewhat further simplify and ease the task of removing nozzle 4.

However, this is not an essential part of the present invention, and another embodiment of the present invention is contemplated in which screw 32 would not clear the walls of nozzle seat 12, but would instead engage or hit those walls as cover 26 is rotated. Thus, to remove nozzle 4 in a sprinkler according to this embodiment, the user would first have to raise screw 32 up out of an interfering position relative to nozzle seat 12, i.e. basically raise screw 32 up until it no longer protrudes below the underside of cover 26. Then, the user would be able to rotate cover 26 sufficiently to push or extend nozzle 4 at least partially out of nozzle seat 12.

A disadvantage of this latter embodiment is that screw 32 has to be raised to remove nozzle 4, and then has to be reset after a new nozzle is installed in nozzle seat 12. However, it does have the advantage of providing some vandal protection as a vandal would not be able to simply reach down and rotate cover 26 to pop the nozzle out as this would be prevented by the engagement of screw 32 with the walls of seat 12. The vandal would have to know that screw 32 would have to be raised, and the vandal would have to have on hand a screwdriver to manipulate screw 32, both of which are somewhat unlikely. Thus, in situations where vandal resistance is important, this latter embodiment of the invention in which screw 32 engages against the walls of nozzle seat 12 may be preferred over the other embodiment in which screw 32 clears nozzle seat 12 whenever cover 26 is rotated.

Regardless of which version of sprinkler is used, screw 32 in both versions is spaced in front of and away from front end 24 of nozzle 4. The only thing that holds nozzle 4 in place is the mating face-to-face engagement of locking rib 42 with nozzle rib 40. There is now no possibility of screw 32 damaging nozzle 4 by being forced into engagement with it when nozzle 4 is retained in nozzle seat 12.

Various modifications of this invention will be apparent to those skilled in the art. Thus, the scope of the invention is to be limited only by the appended claims.

I claim:

1. An improved sprinkler, which comprises:

(a) a nozzle body having a peripheral wall, the nozzle body having a nozzle seat which is recessed relative to the wall of the nozzle body such that the seat extends inwardly from the wall into an interior portion of the nozzle body;

(b) a nozzle which is removably carried in the seat and when fully received in the seat is substantially hidden within the nozzle body so that it cannot be effectively gripped by a user attempting to remove the nozzle; and (c) user operable means carried on the nozzle body for selectively extending the nozzle at least partially out of the seat such that a front end of the nozzle is located exteriorly of the peripheral wall of the nozzle body by a distance which is sufficient to allow the user to grip the nozzle with the user's fingers to thereby allow the user to finish removing the nozzle by pulling the nozzle out of the seat.

2. A sprinkler as recited in claim 1, wherein the nozzle extending means comprises a rotatable cam surface carried on the nozzle body, wherein the cam surface is suited to engage against the nozzle and is shaped to push the nozzle out of its seat during rotation of the cam surface relative to the nozzle body.

3. A sprinkler as recited in claim 2, wherein the nozzle body includes a cover at its upper end, wherein the cover is rotatably mounted on the nozzle body, and wherein the cam surface is formed on an underside of the cover and extends downwardly into the interior of the nozzle body so as to be able to engage against the nozzle.

4. A sprinkler as recited in claim 3, wherein the nozzle includes a nozzle rib formed thereon which extends upwardly towards the cover when the nozzle is received in the seat, and wherein the cam surface is arranged to engage behind the nozzle rib and is arcuately shaped relative to its axis of rotation to push the nozzle out of its seat as the cover is rotated.

5. A sprinkler as recited in claim 3, wherein the cover includes a radius adjustment means that can be selectively positioned in front of the nozzle when the nozzle is received in the seat for deflecting water being sprayed by the nozzle and thereby adjust the throw radius, wherein the radius adjustment means is spaced in front of and away from the front end of the nozzle such that the radius adjustment means does not physically engage the nozzle when the nozzle is fully received in the nozzle seat.

6. A sprinkler as recited in claim 5, wherein the radius adjustment means is located on the cover circumferentially in advance of a front end of the cam surface and has a non-interfering relationship to the nozzle during rotation of the cover such that rotation of the cover to engage the cam surface with the nozzle first moves the radius adjustment means out of the way of the nozzle without having to disturb the setting of the radius adjustment means.

7. A sprinkler as recited in claim 1, wherein the nozzle extending means comprises an operating member which is rotatably carried on the nozzle body, wherein the operating member includes an arcuate cam surface which is suited to engage against the nozzle and is shaped to push the nozzle out of its seat during rotation of the operating member relative to the nozzle body.

8. A sprinkler as recited in claim 7, wherein the operating member further includes means for locking against the nozzle to retain the nozzle in its seat during normal operation of the sprinkler.

9. A sprinkler as recited in claim 8, wherein the nozzle includes a nozzle rib formed thereon which extends towards the cam surface when the nozzle is received in the seat, wherein the cam surface is arranged to engage behind the nozzle rib and is arcuately shaped relative to its axis of rotation to push the nozzle out of its seat as the operating member is rotated, and wherein the locking means includes a locking rib carried on the operating member which locking rib bears against a front face of the nozzle rib to hold the nozzle in place in the seat.

10. A sprinkler as recited in claim 9, wherein the locking rib is located circumferentially spaced in advance of a front end of the cam surface by a distance which is sufficient to allow the locking rib to first disengage the nozzle rib to unlock the nozzle before the front end of the cam surface engages behind the nozzle rib to begin pushing the nozzle out of the seat as the operating member is rotated in a direction to remove the nozzle.

11. A sprinkler as recited in claim 10, wherein the locking rib is circumferentially spaced in advance of the front end of the cam surface sufficiently to create a window in the operating member which is large enough to allow the nozzle to be pushed into the nozzle seat, rotation of the operating member in a first direction with the window initially aligned with the seat causing the locking rib to move in front of the nozzle rib to lock the nozzle in place in the seat, and rotation of the operating member in a second direction which is opposite to the first direction causing the locking rib to first disengage from the nozzle rib, the window to be momentarily aligned with the nozzle seat, and then causing the cam surface to engage behind the nozzle rib to push the nozzle out of its seat.

12. A sprinkler as recited in claim 10, wherein the operating member is a rotatable upper cover of the nozzle body.

13. An improved sprinkler, which comprises:

(a) a nozzle body having a nozzle seat;

(b) a nozzle which is removably carried in the seat; and (c) an operating member which is movably carried on the nozzle body, wherein the operating member includes a cam surface which is suited to engage against the nozzle and is shaped to push the nozzle out of its seat during movement of the operating member relative to the nozzle body, wherein the operating member is selectively operable by the user to assist the user in removing the nozzle from the nozzle seat.

14. A sprinkler as recited in claim 13, wherein the operating member further includes means for locking against the nozzle to retain the nozzle in its seat during normal operation of the sprinkler.

15. A sprinkler as recited in claim 14, wherein the operating member includes a radius adjustment means that can be selectively positioned in front of the nozzle when the nozzle is received in the seat for deflecting the water being sprayed by the nozzle and thereby adjust the throw radius, wherein the radius adjustment means is spaced in front of and away from a front end of the nozzle such that the radius adjustment means does not physically engage the nozzle when the nozzle is fully received in the nozzle seat.

16. A sprinkler as recited in claim 15, wherein the radius adjustment means comprises a selectively adjustable screw.

17. A sprinkler as recited in claim 16, wherein the operating member comprises a cover which closes an upper end of the nozzle body.

18. An improved sprinkler, which comprises:

(a) nozzle body having a nozzle seat;

(b) a nozzle which is removably carried in the seat; and (c) an operating member which is rotatably carried on the nozzle body, wherein the operating member includes means for locking against the nozzle to retain the nozzle in its seat during normal operation of the sprinkler which locking means can be selectively interposed into and out of engagement with the nozzle by rotation of the operating member to lock or unlock the nozzle in the nozzle seat; and (d) further including radius adjustment means that can be selectively positioned in front of the nozzle when the nozzle is received in the seat for deflecting the water being sprayed by the nozzle and thereby adjust the throw radius, wherein the radius adjustment means is spaced in front of and away from a front end of the nozzle such that the radius adjustment means does not physically engage the nozzle when the nozzle is fully received in the nozzle seat.

19. A sprinkler as recited in claim 18, wherein the radius adjustment means comprises a selectively adjustable screw.

20. An improved sprinkler, which comprises:

(a) a nozzle body having a peripheral wall, the nozzle body having a nozzle seat located in the peripheral wall for receiving a nozzle, the nozzle body further having an operating member which is movably carried on the nozzle body;

(b) a nozzle which is removably carried in the seat;

(c) a radius adjustment means carried on the operating member so as to be selectively positioned in front of the nozzle when the nozzle is received in the seat for deflecting water being sprayed by the nozzle and thereby adjust the throw radius, and (d) means operatively connected to the operating member for extending the nozzle at least partially out of its seat during movement of the operating member, and wherein the radius adjustment means is located on the operating member at a position relative to the nozzle extending means such that movement of the operating member first moves the radius adjustment means out of the way of the nozzle before the nozzle extending means becomes operative, whereby the nozzle extending means can be manipulated by the user to push the nozzle at least partially out of its seat without having to disturb the setting of the radius adjustment means.

21. A sprinkler as recited in claim 20, wherein the nozzle extending means comprises a cam surface on the operating member.

22. A sprinkler as recited in claim 20, wherein the operating member comprises a cover which closes an upper end of the nozzle body.

* * * * *